US012295516B1

(12) United States Patent
Daniels

(10) Patent No.: US 12,295,516 B1
(45) Date of Patent: May 13, 2025

(54) SIDE SLEEPING PILLOW

(71) Applicant: Cynthia Daniels, Medina, OH (US)

(72) Inventor: Cynthia Daniels, Medina, OH (US)

( * ) Notice: Subject to any disclaimer, the term of this patent is extended or adjusted under 35 U.S.C. 154(b) by 883 days.

(21) Appl. No.: 17/491,250

(22) Filed: Sep. 30, 2021

Related U.S. Application Data

(63) Continuation-in-part of application No. 16/517,610, filed on Jul. 21, 2019, now abandoned.

(51) Int. Cl.
*A47G 9/10* (2006.01)
*A45F 3/14* (2006.01)

(52) U.S. Cl.
CPC ..... *A47G 9/1054* (2013.01); *A45F 3/14* (2013.01); *A47G 2009/1018* (2013.01)

(58) Field of Classification Search
CPC ..... A47C 21/026; A47G 9/1009; A47G 2009/1018; A47G 9/10; A47G 9/1054; A45F 3/14
USPC ..... 5/636, 652; D6/601
See application file for complete search history.

(56) References Cited

U.S. PATENT DOCUMENTS 4,257,412 A * 3/1981 Guttentag ..... A61F 5/03 128/113.1
5,083,555 A * 1/1992 Lewis ..... A45D 44/22 5/490
5,216,771 A * 6/1993 Hoff ..... A47C 20/025 5/652
5,797,786 A * 8/1998 Smith ..... A41C 3/0064 450/67
5,807,160 A * 9/1998 Wehmeyer ..... A41C 3/00 2/73
6,083,080 A * 7/2000 Lawson ..... A41C 3/10 450/39
6,102,772 A * 8/2000 Fernandez ..... A41C 3/00 450/1
6,769,955 B1 * 8/2004 Fisher ..... A41C 3/005 450/57
6,786,798 B1 * 9/2004 Gendel ..... A41C 3/02 450/36
7,144,295 B2 * 12/2006 Fisher ..... A41C 3/0035 450/57
7,445,541 B2 * 11/2008 Patterson ..... A41C 3/0064 2/463
8,007,343 B1 * 8/2011 Komsky ..... A41C 3/00 2/268
8,047,892 B1 * 11/2011 Dempsey ..... A41C 3/005 450/57
8,216,023 B2 * 7/2012 Donnelly ..... A41C 3/0035 450/89
8,382,692 B1 * 2/2013 Chao ..... A47C 7/383 602/17
8,632,443 B2 * 1/2014 Hauptmann ..... A63B 21/4037 482/121

(Continued)

*Primary Examiner* — Myles A Throop
(74) *Attorney, Agent, or Firm* — Gugliotta & Gugliotta LPA

(57) ABSTRACT

A specialized pillow is provided adapted for a woman's body and having a structure that allows rest with the body lying one's side. A linearly elongated ventral cushion support is provided bilaterally symmetric about a vertical centerline along the coronal plane. A right attachment harness connects with a left attachment harness to circumscribe a user's torso and allow for the ventral cushion support to be positioned against a user's chest along the sternum.

13 Claims, 9 Drawing Sheets

(56) References Cited

U.S. PATENT DOCUMENTS

| | | | | |
|---|---|---|---|---|
| 8,845,388 | B1 * | 9/2014 | Dempsey | A41C 3/005 450/57 |
| 9,370,206 | B1 * | 6/2016 | Ellington | A41C 3/144 |
| 9,622,515 | B1 * | 4/2017 | Dietz | A41C 3/08 |
| 9,681,691 | B1 * | 6/2017 | Hubbs | A41C 3/005 |
| 9,962,314 | B2 * | 5/2018 | Maurette | A61H 19/32 |
| 11,317,658 | B2 * | 5/2022 | Brandt | A41C 3/12 |
| 11,622,640 | B2 * | 4/2023 | Dorsey | A47G 9/10 5/636 |
| 2005/0037688 | A1 * | 2/2005 | Russell | A41C 3/005 450/54 |
| 2006/0112487 | A1 * | 6/2006 | Taylor | A47G 9/0253 5/490 |
| 2008/0079306 | A1 * | 4/2008 | Whelan | A47C 7/029 297/452.41 |
| 2011/0269375 | A1 * | 11/2011 | Fisher-Pacheco | A41C 3/10 450/86 |
| 2013/0036553 | A1 * | 2/2013 | Mann Kass | A47C 20/02 5/630 |
| 2013/0326815 | A1 * | 12/2013 | Smart-Thomas | A47G 9/1081 5/636 |
| 2014/0326251 | A1 * | 11/2014 | Trentacosta | A61F 5/40 128/845 |
| 2016/0120235 | A1 * | 5/2016 | Scotto | A41D 31/18 450/31 |
| 2017/0340126 | A1 * | 11/2017 | Carline | A47G 9/10 |
| 2021/0361093 | A1 * | 11/2021 | Dorsey | A47C 20/02 |
| 2022/0369727 | A1 * | 11/2022 | Middleton | A41C 3/0007 |

* cited by examiner

SIDE SLEEPING PILLOW

RELATED APPLICATIONS

The present invention claims benefit of U.S. Provisional Application 62/701,620, filed on 22 Jul. 2018 and incorporated by reference as if fully rewritten herein.

BACKGROUND OF THE INVENTION

1. Field of the Invention

The present invention generally relates to pillows and, more particularly, to a specialized pillow set suited for a woman's body and having a structure that allows rest with the body lying one's side.

2. Description of the Related Art

Obstructive sleep apnea (OSA) is a form of sleep apnea that occurs more frequently and the most severe when individuals are sleeping in the supine position. Studies and evidence show that OSA related to sleeping in the supine position is related to the airway positioning, reduced lung volume, and the inability of airway muscles to dilate enough to compensate as the airway collapses. With individuals who have OSA, many health care providers encourage their patients to avoid the supine position while asleep and sleep laterally or sleep with the head of their bed up in a 30 or 45-degree angle, or to sleep in a prone or on a side position.

A variety of pillows have been designed to aid in therapy, sleep or relaxation. For example, some pillows are shaped to provide support for a person's neck. Other pillows are designed to provide lumbar support, and still others are designed to support a woman's abdominal and stomach areas during pregnancy. Often, such pillows provide support against specific areas of a person's body, while reducing the pressure exerted on other parts of the person's body by the support surface against which the person sits or lies.

Some methods and devices are known that incorporate various mechanisms for use as anatomically specific cushioning. For example:

U.S. Pat. No. 6,081,948, issued in the name of Copeland, discloses a breast orthotics pillow having a head-and-arm rest portion with an open end, a cavity defined by the head-and-arm rest portion, and a core that fits within the cavity and is composed of a material more resilient than the head-and-arm rest portion. During use of the invention, a woman's breasts rest within and are received by the core. Preferably, the head-and-arm rest portion comprises a back and lateral branches and includes a resilient upper portion positioned directly over a less resilient lower portion, both the upper and lower portions, however, being less resilient than the breasts-receiving core.

U.S. Pat. No. 7,426,762, issued in the name of Dazzi, teaches a pillow suitable for women's body, allowing an easy resting an easy resting to women's chest, keeping breasts separated there between and a raised, unflattened by the body. The pillow has a donut shape additionally allowing an effective body side support, and it comprises: a substantially oval annular pillow main body, having a central opening allowing breast insertion and a resting surface for the chest area surrounding the breast; a pillow secondary body of elongate shape, located transversely to the opening of the main body so as to position itself between the breasts, at the sternum.

U.S. Pat. No. 8,205,286, issued in the name of Diaz, describes a pillow for female breasts, comprising a pillow comprising a first lateral wall, and top and bottom walls. The top wall has first and second openings. The first and second openings receive each breast of a woman when lying thereon. A protective cover comprises a first upper portion, a bottom portion, and a second lateral wall. The first upper portion has first and second interior sidewalls that align with and fit within the first and second openings respectively. An outer cover comprises a second upper portion and a third lateral wall. The second upper portion has first and second pocket members that align with and fit within the first and second interior sidewalls that in turn align with and fit within the first and second openings respectively. The protective cover is dressed on the pillow, and the outer cover is dressed on the protective cover and the pillow.

U.S. Pat. No. 8,458,835, issued in the name of Muratalla, describes a breast support pillow includes a wedge-shaped rectangular even flat surface pad thicker at a top end with an inclined upper surface and being of sufficient length to support a torso and a head of an individual/woman. The pad has a double cup recess within the upper surface at about midpoint of the length of the pad to receive the different sizes of inserts in order to different breasts' sizes of the woman in a comfortable manner therein.

And, U.S. Patent Application Publication No. 2012/0210515, published in the name of Kass et al., disclosed is a substantially "W" shaped pillow, a pillow that is comprised of two half moons on either side of a center support strip. The contour pillow was specifically designed for a woman's body and offers comfortable support for a woman's chest area following chest surgery or breast augmentation. The application side of the pillow is placed against a woman's chest and the pillow supports tender post surgical areas. The side wings rest comfortably under each arm reducing pain and swelling. When movement is restricted and healing muscles and incision sites are supported and protected, there is less pain. The pillow helps a woman rest more comfortably during recovery, helps her to get off of her back faster after surgery, and helps her to sleep in her favorite positions as soon as possible. Quality sleep speeds healing and reduces overall recovery time.

It is preferable that when a pillow is adapted for use with a female's anatomical structure that it is adapted for use with a woman's style of sleep, i.e., back-lying, front lying or side lying. While fewer configuration adaptations are needed for some positions, for those side-sleepers there are comfort impediments that need to be addressed, and in manners specific to an individual woman's anatomy. Consequently, a need has been felt for providing side sleeping support pillow that can alleviates the stress, strain or discomfort to the chest are in a manner that comports with a woman's individual anatomy.

SUMMARY OF THE INVENTION

It is thus an object of the present invention to provide a side sleeping support pillow.

It is a further object of the present invention to provide a side sleeping support pillow adapted for a female anatomy.

It is still a further object of the present invention to provide a side sleeping support pillow that can aid in alleviating discomfort that may be caused when a woman's breasts are impinged or otherwise squeezed together when lying between a supine and a prone position.

The present invention provides a side sleeping support specifically adapted as a specialized pillow suited for a woman's body and having a structure that allows rest with the body lying one's side. A generally linearly elongated ventral cushion support is provided bilaterally symmetric about a vertical centerline along the coronal plane. An upper attachment harness extending from a top end, and a lower attachment harness extending from a bottom end, are used to circumscribe a user's torso and allow for the ventral cushion support to be positioned against a user's chest along the sternum. A first slightly concave surface along the left side is contra lateral to a second slightly concave surface along the right side and forms a medial contour. Each concave surface provides a cushioning and support surface to medial surfaces of the user's breasts. The ventral cushion support is formed of an open foam inner body encased in an outer sheath formed of satin or similar low-friction material such as to form a release surface inside, at the foam outer surface, as well as at the sheath outer surface where it will contact the user's body, clothing or bedding. Further, the foam inner body is of a sufficient rigidity and resiliency such as to provide sufficient structure and support when laterally placed between a woman's breast while lying or sleeping.

It is an advantage of the present invention to provide a cushioned separator for female breasts during sleep.

It is another advantage of the present invention to prevent the squeezing of a user's breast while sleeping, thereby reducing strain and stress imparted onto the skin.

Further objects, features and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
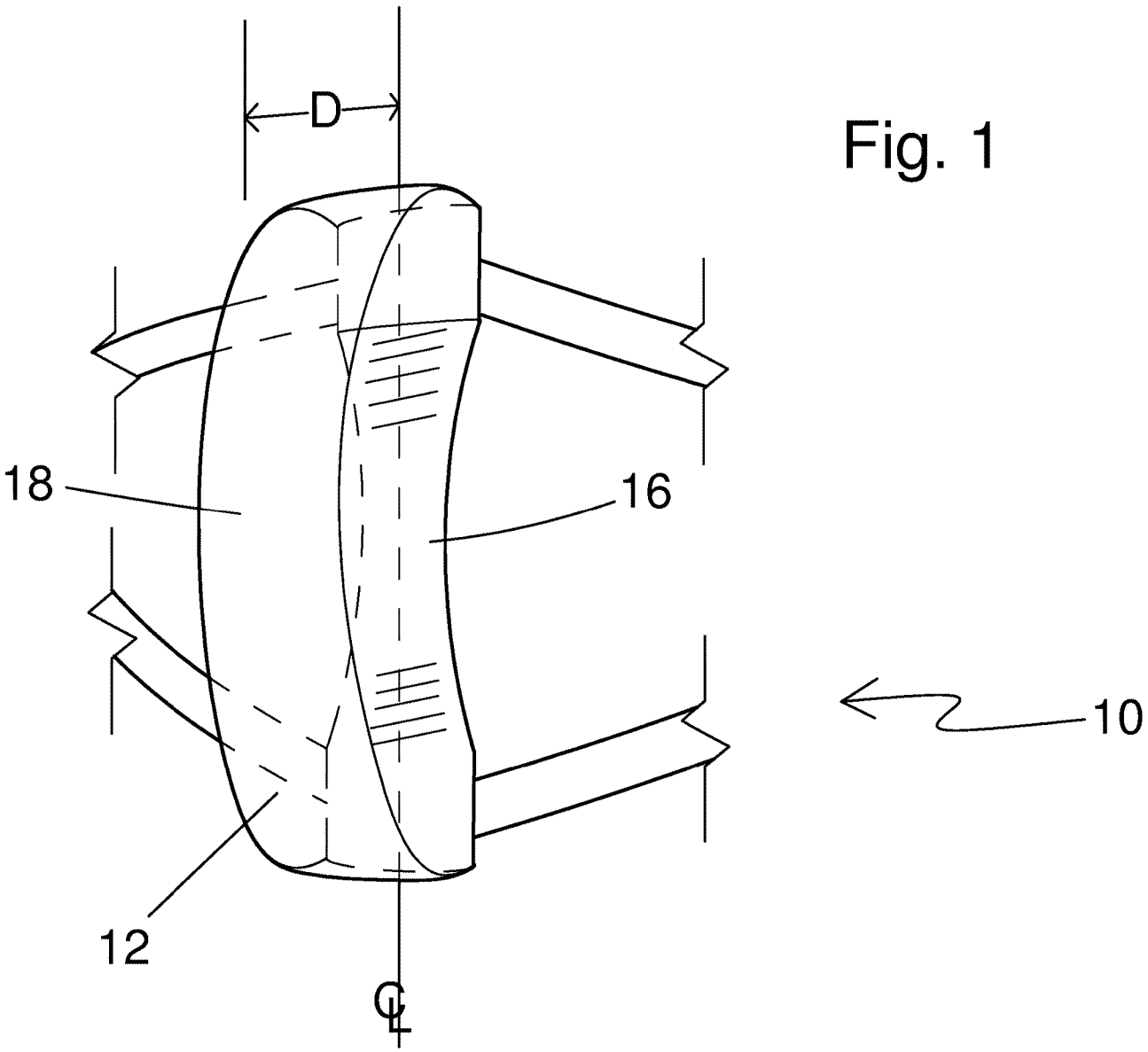
FIG. 1 is a front perspective view of a side sleeping pillow according to the preferred embodiment of the present invention.
Figure 2:
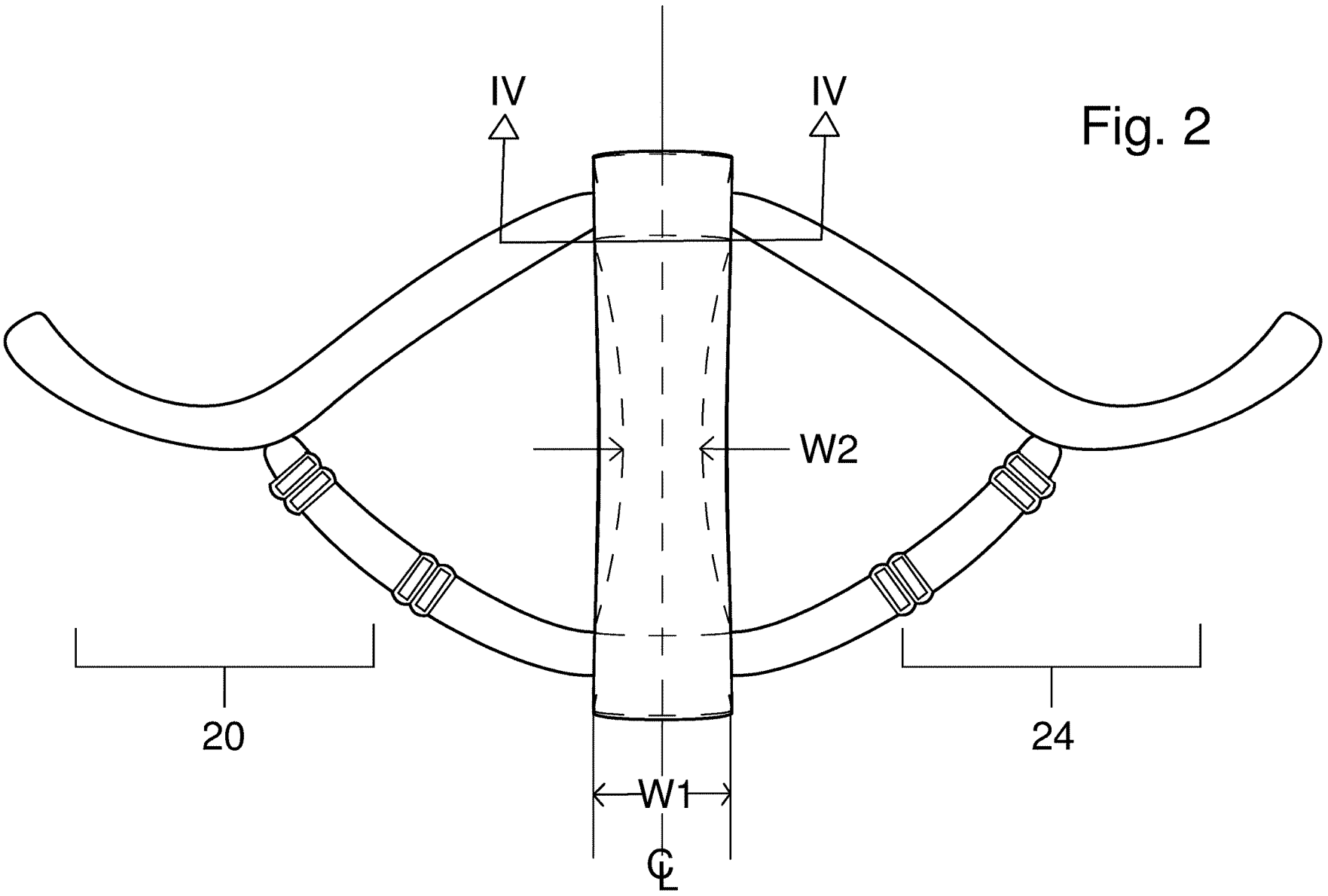
FIG. 2 is a front elevational view thereof.
Figure 3:
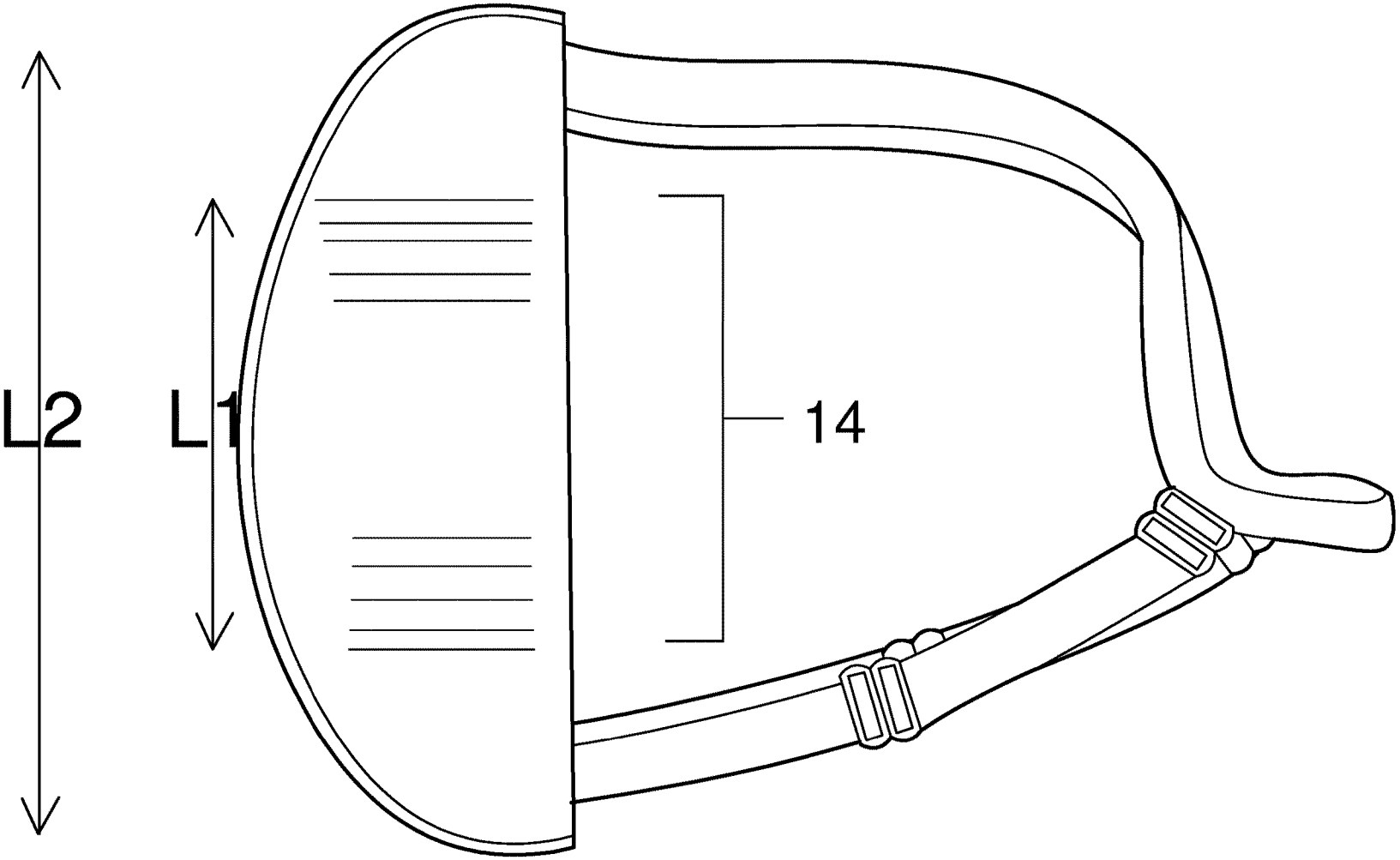
FIG. 3 is a left side elevational view thereof, the right side being a mirror image.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Referring now to the drawings, wherein like reference numerals indicate the same parts throughout the several views, a side sleeping support, generally noted as 10, is provided as a specialized pillow suited for a woman's body. A generally linearly elongated ventral cushion support 12 is provided bilaterally symmetric about a vertical centerline "CL". The symmetric shape along the coronal plane is of slight, generally hourglass-like shape, forming a medial contour 14 having a first slight concave surface 16 on a left side contra lateral to a second slight contour surface 18 on a right side. A top attachment harness 20 extending from the upper end 22, and is adapted to circumscribe a user's upper torso, above the breasts and around the back while directed under the arms. A bottom attachment harness 24 extending from a bottom end 26 similarly circumscribes a user's torso, below the breasts and around the back. The interconnecting attachment harnesses 20, 24 are used to circumscribe a user's torso and allow for the ventral cushion support 12 to be positioned against a user's chest along the sternum.

The ventral support cushion 12 has an overall width "W1", and the medial contour 14 forms an innermost width "W2" forming a slightly rounded biconic shape with each concave surface 16, 18 providing a cushioning and support surface to medial surfaces of the user's breasts. To provide such support, it is envisioned that the cushion 12 would further have a generally supportive depth D to provide at least several inches of supportive material. In order to conform to the female anatomy and to adapt to the intended use, in a preferred embodiment of the present invention width W1 is greater than width W2. According to another aspect of the present invention, width W2 is greater than or equal to more than half the width W1. Further, medial counter section 14 has an overall length L1 that is a fraction of the overall length L2 of the ventral cushion support 12. In order to conform to the female anatomy and to adapt to the intended use, in a preferred embodiment of the present invention length L2 is greater or equal to the length L1. According to another aspect of the present invention, length L2 is greater than or equal to twice the length L1.

Figure 4:
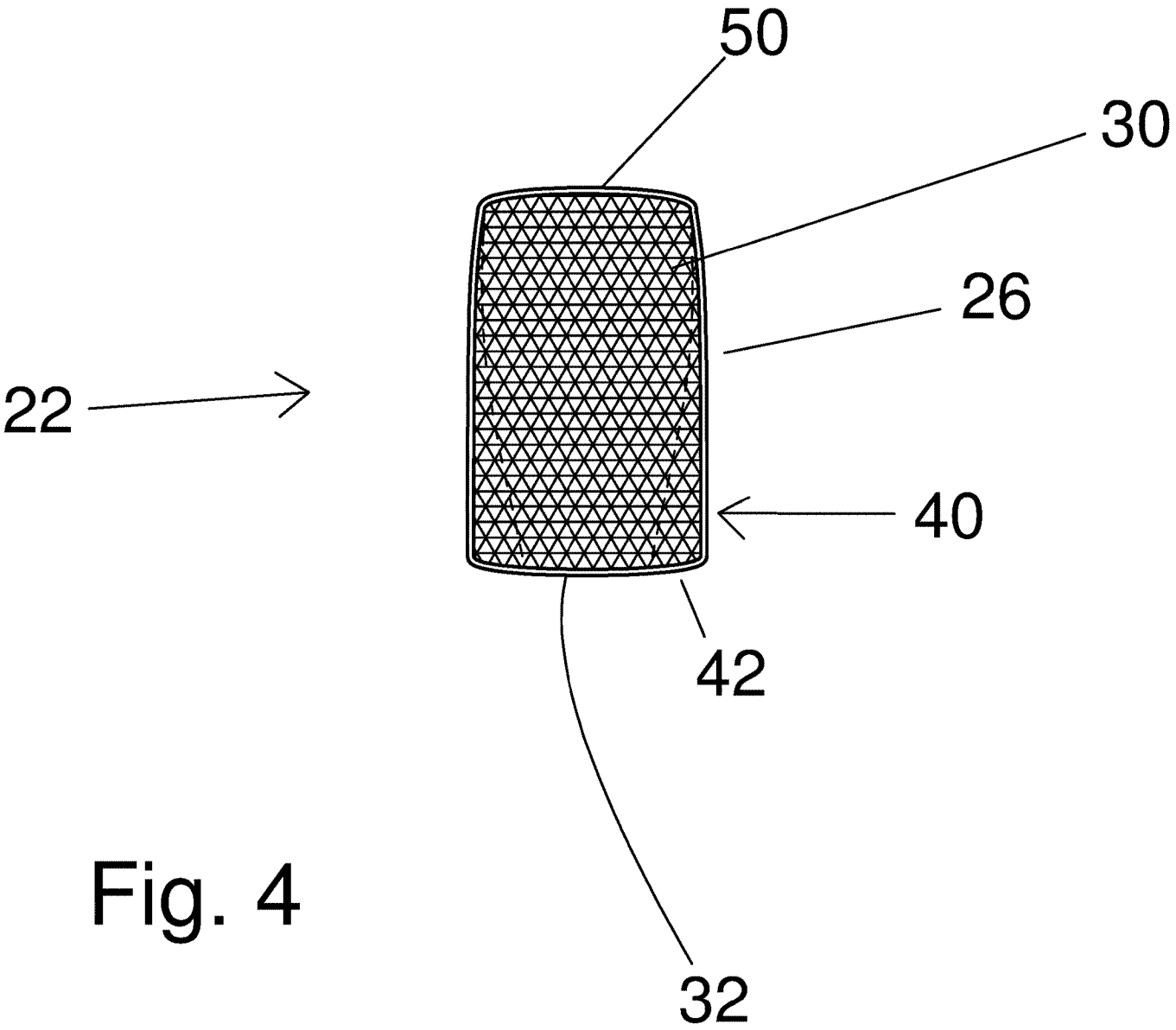
FIG. 4 is a cross sectional view taken along line IV-IV of FIG. 2.

As best shown in conjunction FIG. 4, the ventral cushion support 12 is formed of an open foam inner body 30 encased in an outer sheath 32. The outer sheath 32 is best formed of silk, satin or similar low-friction material such as to form a release surface inside, at the foam outer surface 40, as well as at the sheath outer surface 42 where it will contact the user's body, clothing or bedding. Optionally, a separable seam 50 using a reclosable fastener such as a slide fastener, hook and loop fastener or other type of closure may be incorporated such that the inner foam member 30 is removable and the sheath 40 can be replaceable or easily washable.

In addition to the geometric limitations of a supportive depth D providing at least several inches of supportive material, the foam is selected having an effective ILD ("Indentation Load Deflection") or IFD ("Indentation Force Deflection") of between 10-40 IFD/ILD and a shore hardness of between 40-80 degrees. The second attachment harness is positioned to avoid contact with sensitive areas of the user's body, such as under the breasts and along the ribcage, providing enhanced comfort during long durations of side sleeping. Sensitive areas may include areas prone to chafing, irritation, or discomfort when in prolonged contact with straps or fasteners.

2. Operation of the Preferred Embodiment

Figure 5:
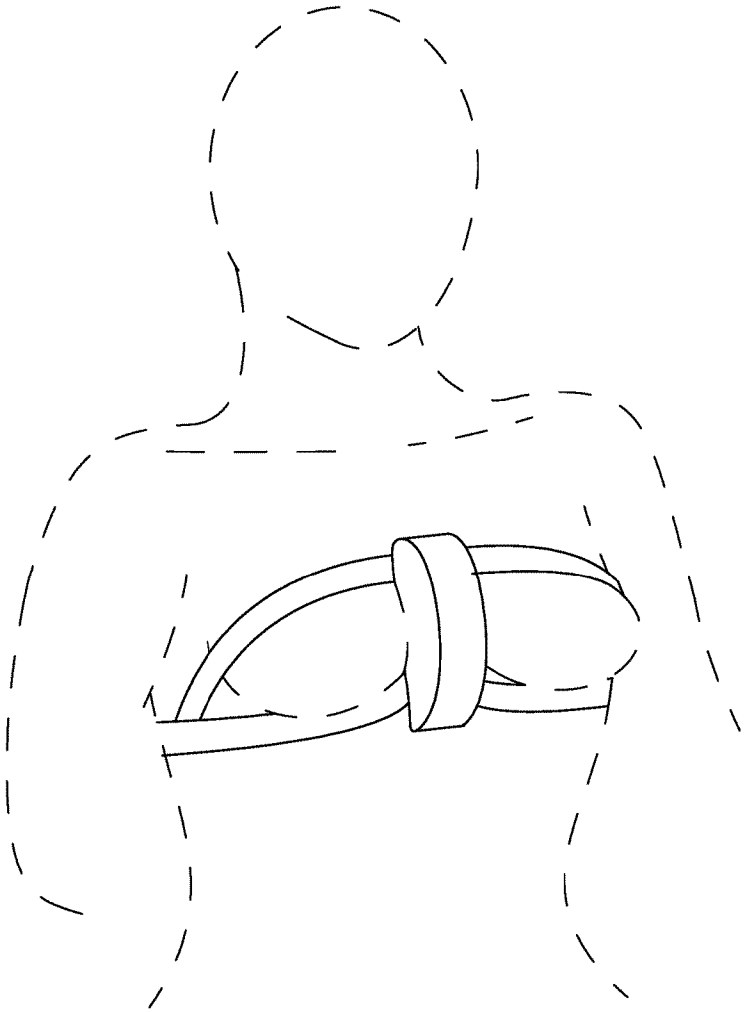
FIG. 5 is a pictorial illustration showing the sleeping pillow of the present invention in a typical use as a side sleeping support.
Figure 6:
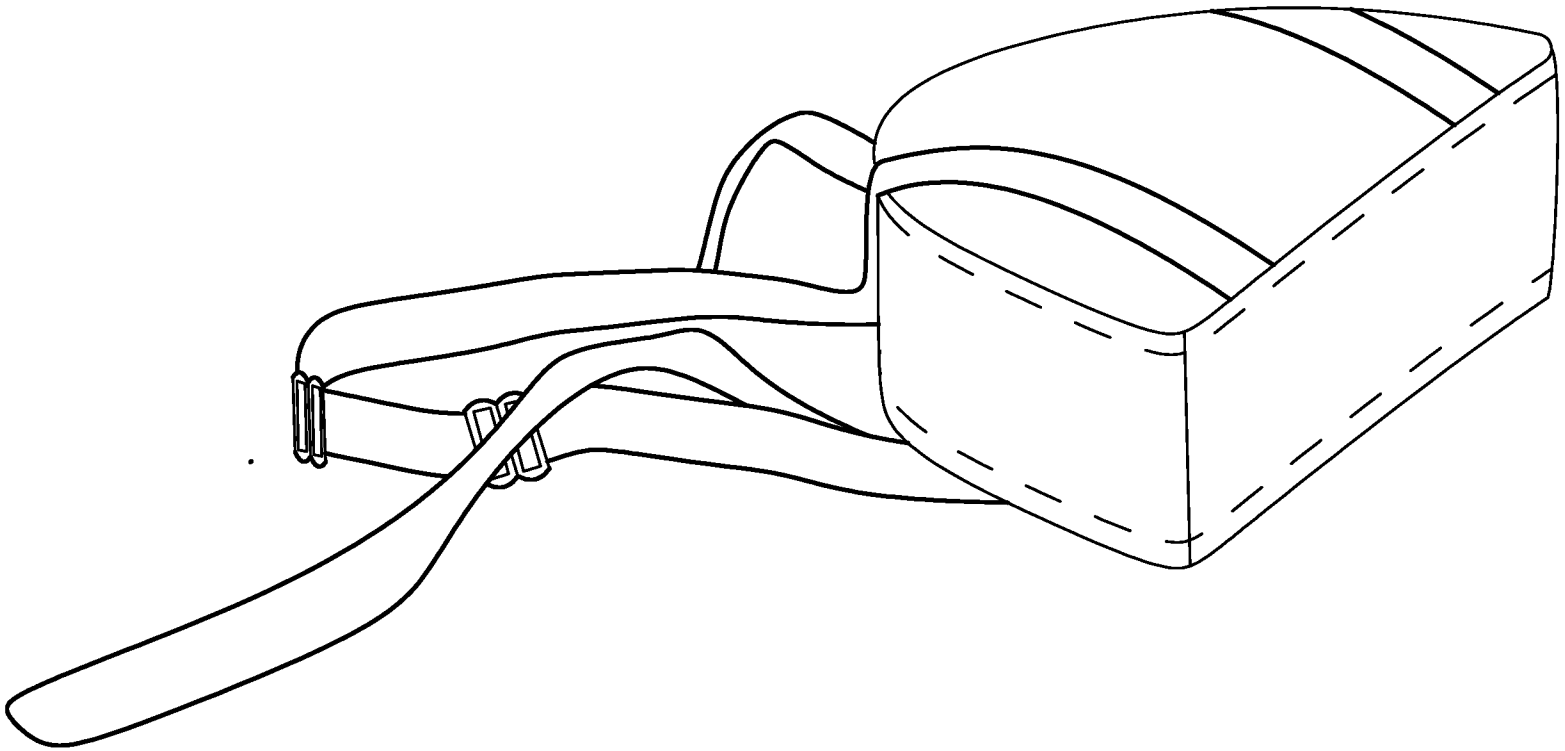
FIG. 6 is a side perspective view of a side sleeping pillow according to a first alternate configuration of the preferred embodiment of the present invention.
Figure 7:
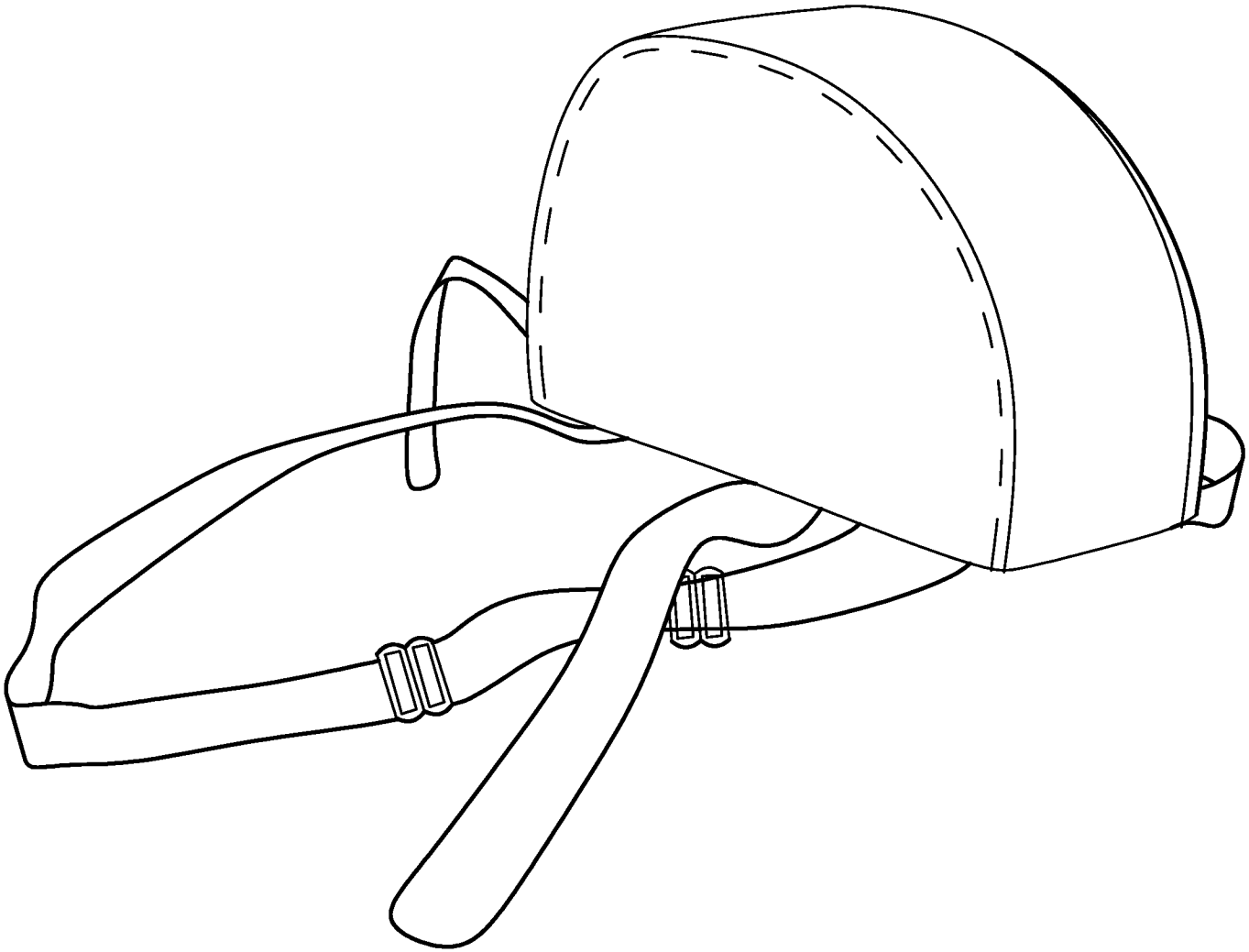
FIG. 7 is a top perspective view thereof.
Figure 8:
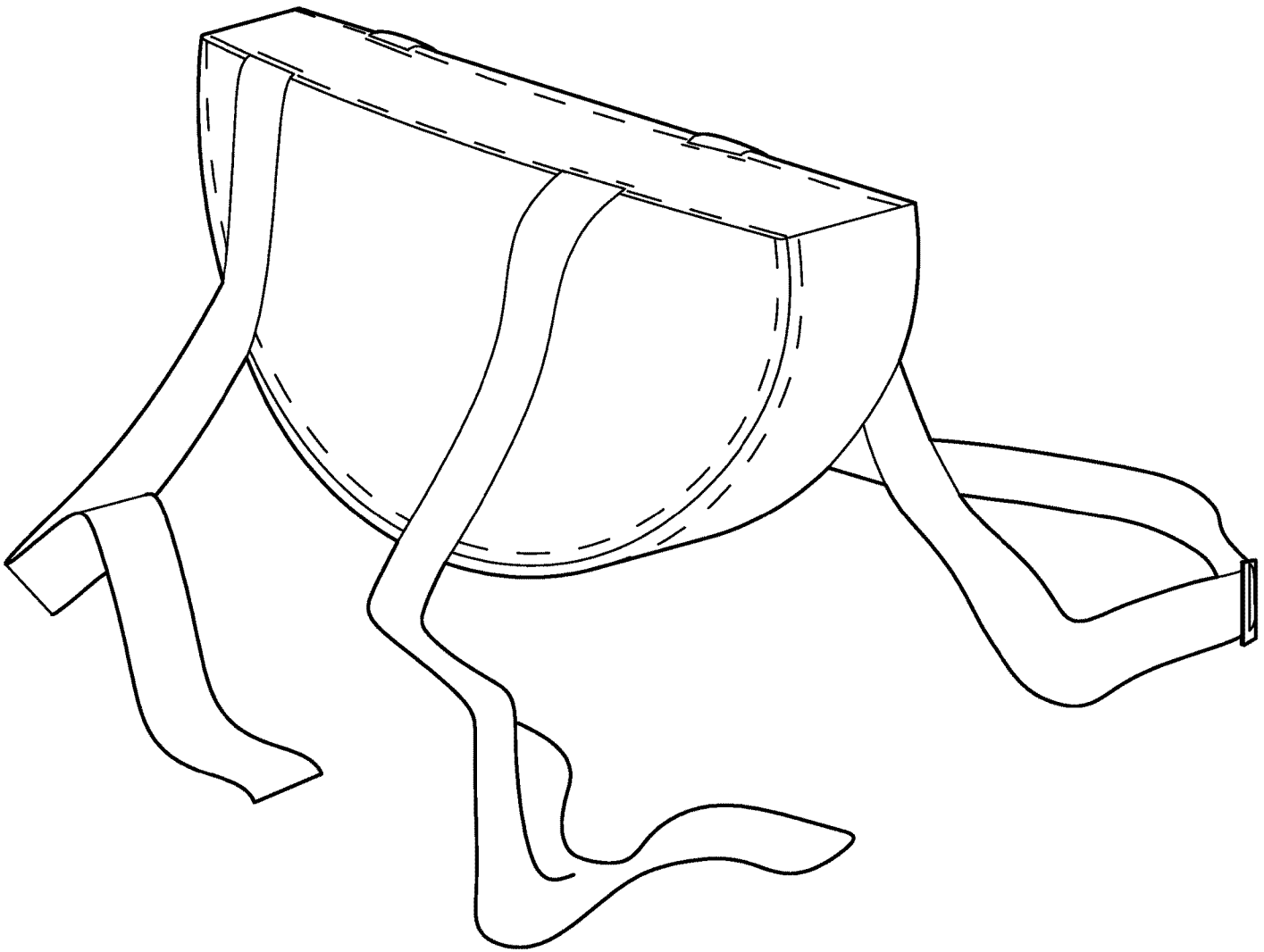
FIG. 8 is a rear perspective view thereof.
Figure 9:
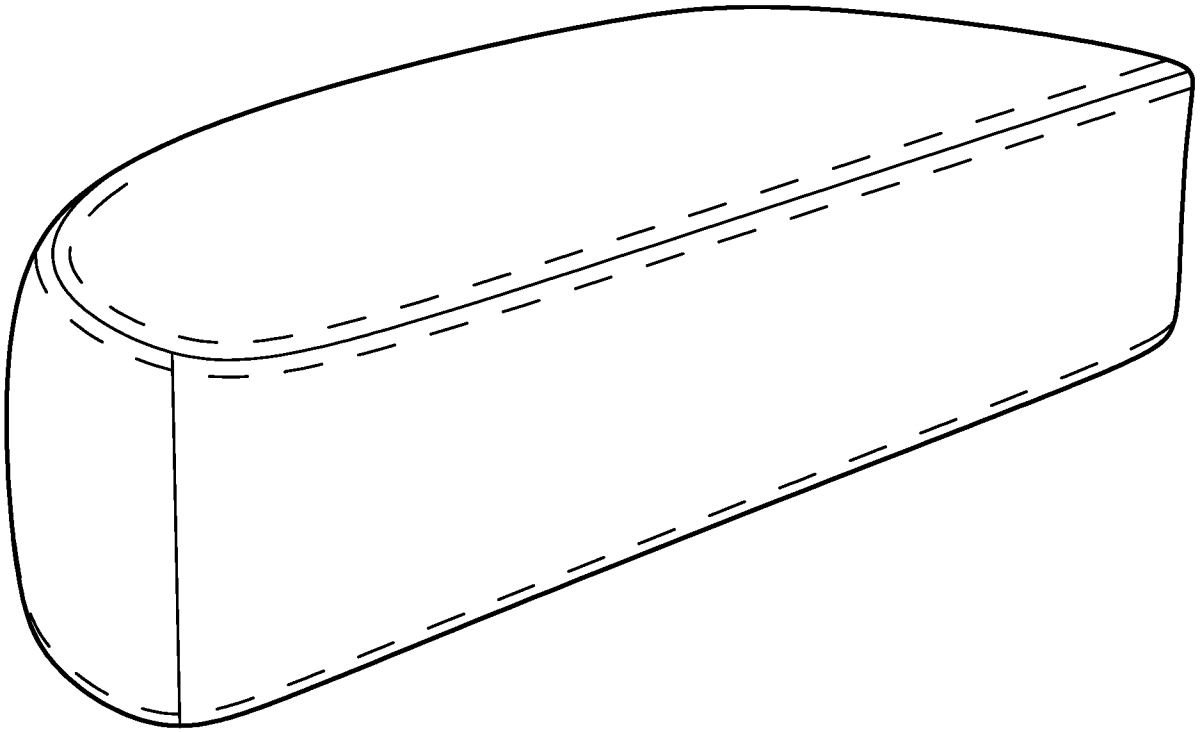
FIG. 9 is a perspective view of an elongated ventral cushion support 12 without attachment harness 20 as used according to the first alternate configuration of the preferred embodiment of the present invention.

As best shown in conjunction with FIG. 5, in operation the ventral support cushion 12 is positioned along a user's sternum, against the body with the medial contour positioned between a user's breasts. With this configuration, the breasts are gently separated and resist being compressed when a user moves to a side sleeping position. Thus, a woman's body is prevented for having external strain or stress applied to the skin during sleep to avoid discomfort, stretching, wrinkles and other unpleasant effects that may result when a female is positioned on her side during sleep. The breasts remain in a natural position and are prevented from causing discomfort, pain or irritation when the user positions herself during sleep.

It is understood that the above described pillow may be provided in different sizes, with particular reference to height and width, in order to fit different breast sizes and chest widths. One such alternate configuration of the preferred embodiment of the present invention is best shown in conjunction with FIG. 6 through FIG. 9.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as is suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company, v. Hilton Davis Chemical,* 520 US 17 (1997) or *Festo Corp. v. Shoketsu Kinzoku Kogyo Kabushiki Co.,* 535 U.S. 722 (2002), or other similar caselaw or subsequent precedent should not be made if any future claims are added or amended subsequent to this Patent Application.

What is claimed is:

1. A side sleeping support pillow comprising:

a ventral cushion support having an elongated body with a convex distal edge and a linear proximal edge, the body being bilaterally symmetric about a vertical centerline and having an hourglass-like shape along a coronal plane;

the ventral cushion support having a medial contour comprising first and second opposed concave surfaces on left and right sides respectively, each concave surface configured to provide cushioning support to medial surfaces of a user's breasts;

wherein the ventral cushion support has an overall width and an innermost width at the medial contour, the innermost width being less than the overall width;

an open-cell foam inner body encased within a low-friction outer sheath;

a first attachment harness extending from an upper end of the ventral cushion support; and a second attachment harness extending from a lower end of the ventral cushion support;

wherein the first and second attachment harnesses are configured to adjustably circumscribe a user's torso to position the ventral cushion support against the user's sternum between the user's breasts;

wherein the ventral cushion support has a supportive depth of at least three inches between the concave surfaces; and wherein the first and second attachment harnesses comprise elastic straps with adjustable fasteners to accommodate various torso sizes while maintaining a snug fit.

2. The side sleeping support pillow of claim 1, wherein the open-cell foam inner body has an Indentation Load Deflection (ILD) between 10-40, specifically chosen to provide optimal support and comfort for a user's breasts during side sleeping while preventing wrinkles in the cleavage area.

3. The side sleeping support pillow of claim 1, wherein the low-friction outer sheath is formed of silk or satin.

4. The side sleeping support pillow of claim 1, wherein the outer sheath comprises a separable seam with a reclosable fastener allowing removal of the inner foam body.

5. The side sleeping support pillow of claim 1, wherein the ventral cushion support has an overall length and a medial contour length, the medial contour length being less than the overall length.

6. The side sleeping support pillow of claim 1, wherein the first attachment harness is configured to circumscribe a user's upper torso above the breasts and the second attachment harness is configured to circumscribe the user's torso below the breasts.

7. A method of using the side sleeping support pillow of claim 1, comprising:

positioning the ventral cushion support against a user's sternum between the user's breasts;

securing the first attachment harness around the user's upper torso above the breasts; and securing the second attachment harness around the user's torso below the breasts.

8. A side sleeping support pillow specifically adapted for a user's anatomy, comprising:

a linearly elongated ventral cushion support being bilaterally symmetric about a vertical centerline along a coronal plane;

a medial contour section along the ventral cushion support having first and second concave surfaces on opposing sides, each configured to provide cushioning and support to medial surfaces of the user's breasts;

the ventral cushion support having a supportive depth of at least three inches between the concave surfaces;

a first attachment harness extending from an upper portion of the ventral cushion support, configured to circumscribe the user's upper torso above the breasts;

a second attachment harness extending from a lower portion of the ventral cushion support, configured to circumscribe the user's torso below the breasts; and an open-cell foam inner body encased within a low-friction outer sheath; wherein the ventral cushion support has an overall width at its widest point and an innermost width at the medial contour, the innermost width being at least half the overall width; wherein the first and second attachment harnesses comprise adjustable elastic straps configured to provide a snug fit while allowing for user movement during sleep; and wherein the open-cell foam inner body has an Indentation Load Deflection (ILD) between 15 and 30, optimized for providing both firmness and comfort for side sleeping.

9. The side sleeping support pillow of claim 8, wherein the first attachment harness includes adjustable fasteners to accommodate various torso sizes.

10. The side sleeping support pillow of claim 8, wherein the outer sheath comprises a reclosable seam with a fastener that allows removal of the inner foam body for cleaning or replacement.

11. A method of using the side sleeping support pillow of claim 8, comprising:

positioning the ventral cushion support against the user's sternum between the breasts;

securing the first attachment harness around the user's upper torso above the breasts;

securing the second attachment harness around the user's torso below the breasts;

adjusting the position of the concave surfaces to provide support to the medial surfaces of the breasts while sleeping in a side-lying position.

12. The side sleeping support pillow of claim 8, wherein the first attachment harness includes adjustable fasteners to accommodate various torso sizes.

13. The side sleeping support pillow of claim 8, wherein the second attachment harness is positioned to avoid contact with sensitive areas of the user's body, providing enhanced comfort during long durations of side sleeping.

* * * * *